United States Patent [19]

Nordskog

[11] Patent Number: 4,781,315

[45] Date of Patent: Nov. 1, 1988

[54] DETACHABLE WRISTBAND CARRIER

[76] Inventor: Erik R. Nordskog, 18653 Ventura Blvd., #300, Tarzana, Calif. 91356

[21] Appl. No.: 906,820

[22] Filed: Sep. 12, 1986

[51] Int. Cl.[4] ..... A44C 5/00

[52] U.S. Cl. ..... 224/165; 224/173; 224/253

[58] Field of Search ..... 224/219, 222, 267, 164–178, 224/250, 253, 217, 218, 221, 252, 254, 255; 2/183

[56] References Cited

U.S. PATENT DOCUMENTS

| | | | |
|---|---|---|---|
| D. 52,465 | 9/1918 | Block | 224/165 X |
| 275,780 | 4/1883 | Mahar | 224/217 |
| 1,352,863 | 9/1920 | Zeitler et al. | 224/221 |
| 1,486,178 | 3/1924 | Antelmi | 224/253 X |
| 1,573,239 | 2/1926 | Gilliland | 224/219 X |
| 1,592,534 | 7/1926 | Mitchel | 224/218 X |
| 1,631,371 | 6/1927 | Greubel | 224/253 X |
| 1,766,478 | 6/1930 | Baker et al. | 224/218 |
| 1,806,477 | 5/1931 | Lloyd et al. | 224/253 X |
| 1,823,814 | 9/1931 | Aiello | 224/219 X |
| 2,203,155 | 6/1940 | Jullien et al. | 224/253 X |
| 2,213,472 | 9/1940 | Myres | 224/253 X |
| 2,586,740 | 2/1952 | Swanson | 224/252 |
| 3,010,627 | 11/1961 | Hoover | 224/165 X |
| 3,148,426 | 9/1964 | Lesser et al. | 224/163 X |
| 3,202,331 | 8/1965 | McKinstrie | 224/221 |
| 4,401,233 | 8/1983 | Frey | 224/219 X |
| 4,467,947 | 8/1984 | Minneman | 224/253 |
| 4,481,681 | 11/1984 | Hankin | 2/183 X |
| 4,659,000 | 4/1987 | Sales et al. | 224/252 |
| 4,662,552 | 5/1987 | Uyehara | 224/253 X |

FOREIGN PATENT DOCUMENTS

| | | | |
|---|---|---|---|
| 456062 | 2/1928 | Fed. Rep. of Germany | 224/165 |
| 2269313 | 11/1975 | France | 224/267 |
| 18955 | of 1913 | United Kingdom | 224/165 |

*Primary Examiner*—Renee S. Luebke
*Assistant Examiner*—Robert M. Petrik
*Attorney, Agent, or Firm*—Marvin H. Kleinberg; Matthew F. Jodziewicz

[57] ABSTRACT

A carrier for releasable attachment to a band includes a hollow housing with side and bottom portions. The side and bottom portions have at least one pair of protuberances integrally formed adjacent the bottom portion on opposite side portions of the hollow housing. Each of the protuberances form, with the corresponding side portions, a channel adapted to receive therein a flexible, elastomeric cable adapted to engage both of the channels formed by the pair of protuberances and to extend across the bottom portion of the housing. The cable is sufficiently flexible to encircle the band to hold both the bottom portion of the housing and the band in a releasable adjacent relation.

4 Claims, 2 Drawing Sheets

DETACHABLE WRISTBAND CARRIER

BACKGROUND OF THE INVENTION

1. Field of the Invention

This invention relates in general to portable containers for carrying items, and, more particularly, to a container that is capable of being releasably affixed to a watch band.

2. Description of the Related Art

The state of the art known to the applicant requires that small items that are to be carried by an individual be carried in pockets, inserted in waistbands or the like, or directly affixed to either a piece of clothing worn by the individual or associated directly around an extending limb of the human body, such as by being provided with an attachment band for looping around the neck, an arm or a leg.

In the prior art, the individual may be forced to damage his clothing to attach the container or to carry an additional strap around his arm or wrist just to carry the container. Containers that are tucked in waistbands may be lost. It is therefore difficult for an individual to use such containers when at the beach wearing only a swimsuit or when wearing clothing that would be damaged by attaching a container. Further, carrying items between the body and a swimsuit creates unsightly bulges and cannot be considered safe or secure.

Yet, it is just when an individual participates in sports such as swimming, jogging, wind surfing, running, tennis or snow skiing for example, that it is difficult to carry certain items, such as lip balm or sun block, or other small items without a great deal of bother.

Similarly, an individual engaged in an activity such as backpacking strives to eliminate unnecessary weight, and would hesitate to carry a container that unnecessarily adds additional weight and bulk without a corresponding benefit. Moreover, when carrying a pack, it is often difficult to retrieve small items from the pack or from pockets in clothing.

SUMMARY OF THE INVENTION

It is an object of the present invention, therefore, to provide a carrier for releasable attachment to a band that is non-damaging to the band and can be quickly and easily attached or removed.

It is another object of the present invention to provide a carrier that can be releasably attached to a watch band being worn by an individual.

In general, one preferred embodiment of a carrier for releasable attachment to a band includes a hollow housing with side and bottom portions. A cover member can be permanently attached to the housing so that the resulting closeable container can be used for liquids, solids, and small articles, such as coins, tablets, or the like. The carrier has at least one pair of protuberances formed adjacent the bottom portion on opposite side portions of the hollow housing. Each of the protuberances form, with the corresponding side portions, a channel adapted to receive therein a flexible, toroidally-shaped, elastomeric cable adapted to engage both of the channels formed by the pair of protuberances and to extend across the bottom portion of the housing. The cable is sufficiently flexible to encircle the band to hold the bottom portion of the housing and the band in a releasable adjacent relation.

Another preferred embodiment of a carrier for releasable attachment to a band constructed in accordance with the invention herein includes a hollow housing with side and bottom portions. The side and bottom portions have at least one pair of straps integrally formed adjacent the bottom portion on opposite side portions of the housing. One of the straps has a plurality of protuberances and the other strap has a plurality of holes therein which are adapted to receive therein at least one of the protuberances in a snap-fitting, releasable relation so that the straps may be joined together to form a closed loop. The loop has a diameter sufficient to encircle the band and hold both the bottom portion of the housing and the band in a releasable adjacent relation.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENTS

Figure 1:
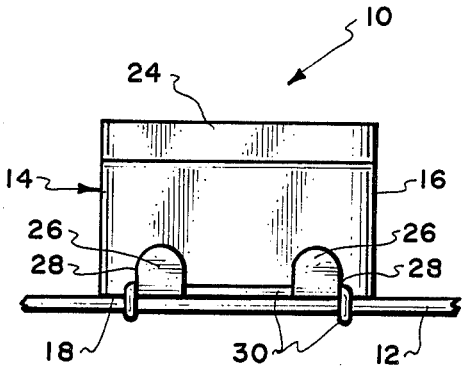
FIG. 1 is a side view of a carrier constructed in accordance with the invention herein.
Figure 2:
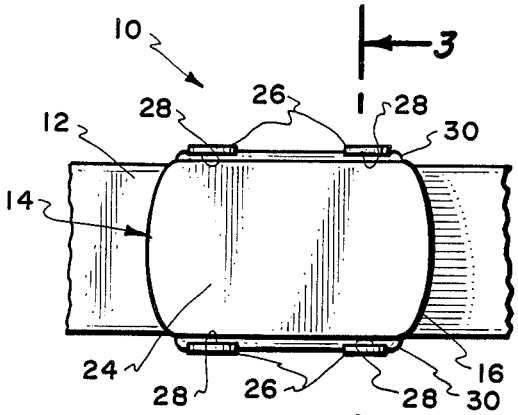
FIG. 2 is a top view of the carrier of FIG. 1.

In general, as seen in FIGS. 1 and 2, a preferred embodiment of a carrier 10 for releasable attachment to a band 12 includes a hollow housing 14 with side portions 16 and bottom portion 18. While it is possible that carrier 10 will more often than not be releasably attached to a wrist band associated with an individual's wristwatch, carrier 10 may be attached to any band 12 and should not be limited to association with a watch band.

Carrier 10 is preferably formed from non-porous, water-proof material, such as plastic, which is easily and inexpensively formed by injection molding into a hollow housing 14. Carrier 10 may also be formed of material that is tinted or treated to safeguard any item contained with hollow housing 14 from harmful effects of sunlight or heat.

In order for the hollow housing 14 to usefully carry an item, an aperture 20 is formed in the top portion 22 of the hollow housing 14. A cap 24 can be integrally hinged to the hollow housing 14 adjacent the top portion 22 and is adapted to engage the side portions 16 of the hollow housing 14 in a frictional engagement to sealingly cover the aperture 20 in the hollow housing 14. Accordingly, the cap 24 may be used to safeguard any items held in hollow housing 14 from water, sunlight or loss until the cap 24 is opened and the items are removed by the wearer of the carrier 10. The cap 24 can also protect liquid or solid contents such as sun screens, lip balm or cosmetic items.

A number of attachment means may be integrally formed or joined on the side portions 16 of the hollow housing 14 for releasably attaching the carrier 10 to band 12. Chief among the various means available are the following preferable embodiments.

Figure 3A:
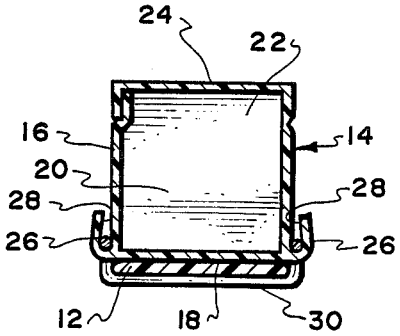
FIGS. 3*a* through 3*f* are various alternate cross section views taken along the line 3—3 of FIG. 2.
Figure 3B:
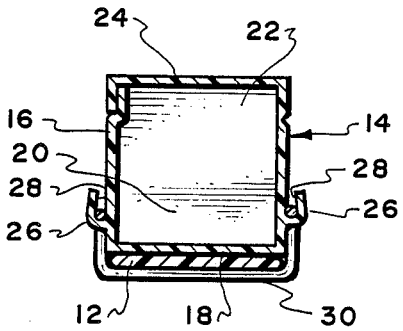
Figure 3C:
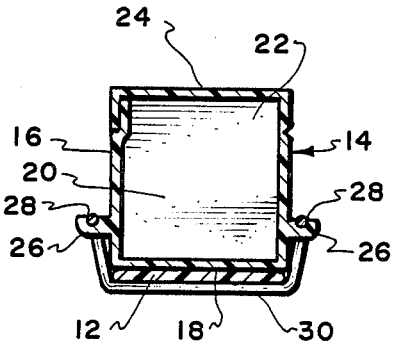

First, the side portions 16 and bottom portion 18 may have at least one pair of protuberances 26 integrally formed adjacent the bottom portion 18 of the hollow housing 14 on opposite side portions 16 of the hollow housing 14, as best shown in FIGS. 3*a* through 3*c*.

As seen in FIG. 3*a*, the protuberances 26 may be positioned on the side portions 16 adjacent the bottom portion 18, or, as shown in FIG. 3*b*, at some point on the side portions 16 intermediate the top portion 22 and the bottom portion 18 of the hollow housing 14.

Figure 4:
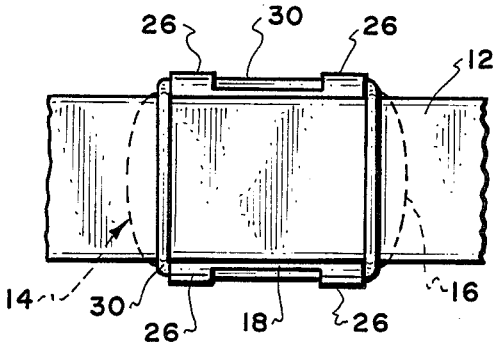
FIG. 4 is a bottom view of the carrier of FIG. 1.
Figure 5A:
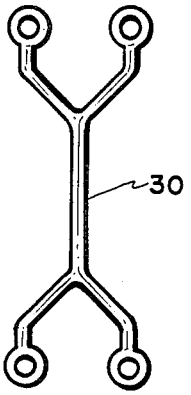
FIGS. 5*a* through 5*d* are various alternate flexible cables that can be utilized with the hollow housing of the invention.
Figure 5B:
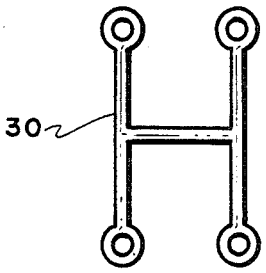
Figure 5C:
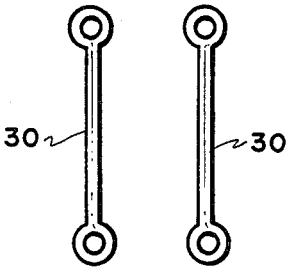
Figure 5D:
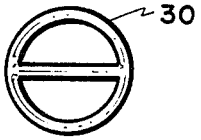

Each of the protuberances 26 forms, with the corresponding side portions 16, a channel 28 adapted to receive therein a flexible, elastomeric loop or cable 30 adapted to engage both of the channels 28 formed by the pair of protuberances 26 and to extend across the bottom portion 18 of the hollow housing 14 as is seen in FIG. 4.

The cable 30 may be made of any material, such as rubber or plastic, that is sufficiently flexible to encircle the band 12 to hold the bottom portion 18 of the hollow housing 14 and the band 12 in a releasable adjacent relation as seen in FIGS. 1, 2 and 4.

Figure 3D:
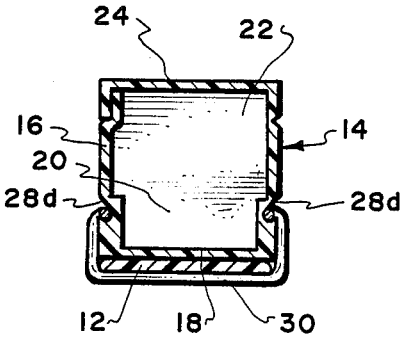

A second preferable embodiment of attachment means would be to provide indented channels 28*d* formed in the side portions 16 of the hollow housing 14 intermediate the top portion 22 and the bottom portion 18 as illustrated in FIG. 3*d*. Indented channels 28*d* would provide a cavity into which cable 30 could be both inserted and releasably retained.

Figure 3E:
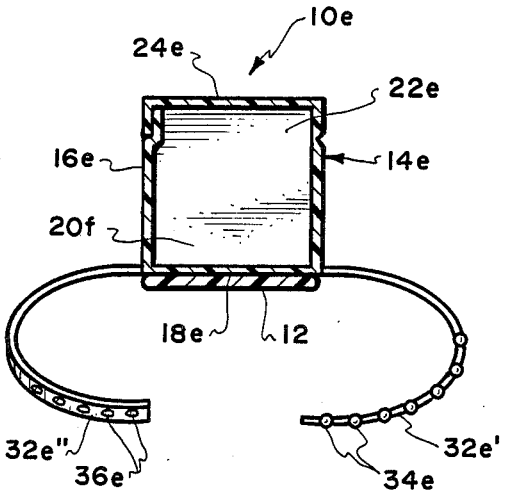

A third preferable embodiment of attachment means is illustrated in FIG. 3*e* and includes a carrier 10*e* for releasable attachment to a band 12*e* having a hollow housing 14*e* with side portions 16*e* and bottom portion 18*e*. The side portions 16*e* and bottom portion 18*e* have at least one pair of integral straps 32*e* formed adjacent the bottom portion 18*e* on opposite side portions 16*e* of the hollow housing 14*e*. One of the straps 32*e*′ has a plurality of protuberances 34*e* and the other strap 32*e*″ has a plurality of holes 36*e* therein which are adapted to receive therein at least one of the protuberances 34*e* in a snap-fitting, releasable relation so that the straps 32*e* may be joined to form a loop that could encircle the band 12*e*.

Figure 3F:
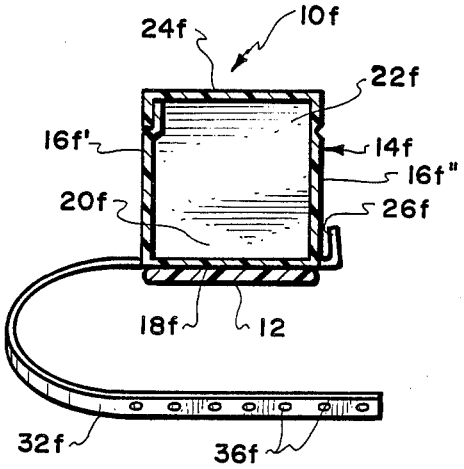

Yet another attachment means are shown in FIG. 3*f* combining the attributes of the above described protuberances and straps. As seen in FIG. 3*f*, the carrier 10*f* has a hollow housing 14*f* with side portions 16*f* and bottom portion 18*f*. The side portion 16*f* has an integrally formed strap 32*f* which is sufficiently long to encircle the band 12*f* and extend beyond to engage a protuberance 26*f* formed on the side portion 16*f*″. Strap 32*f* has a plurality of holes 36*f* formed therein adapted to receive therein protuberance 26*f* so that strap 32*f* is releasably held in place encircling the band 12*f* and retaining the carrier 10*f* in place on the band 12*f*.

Additionally, to insure that cable 30 does not inadvertently become loose from channel 28, the extreme end 38 of protuberances 26 may be inwardly disposed or bent toward the side portions 16 of the hollow housing 14 to form a C-shaped channel that would make it more difficult for cable 30 to fall out of channel 28.

As indicated above, carrier 10 may be attached to any band 12 and should not be limited to association with a watch band. For example, device 10 can be attached to a band or base member 12 which can include, but not be limited to objects such as, ski poles, eyeglass frames, or temples, fishing rods, and the like, by encircling a portion of the base member 12 with the cable 30 which then engages protuberances 26 to hold the hollow housing 14 in a releasably attached relation to the base member 12 as is shown in FIGS. 1, 2 and 4.

While the hollow housing 14 of the carrier 10 is capable of having any desired size, in instances where it is to be carried on a watch band, hollow housing 14 is preferably oblong in shape and has a width equal to or less than the width of the band to which it is to be attached. In this manner, the carrier 10 will more closely fit the band on which it is attached and have less of a tendency to catch on objects or to impede the wearer in movement.

FIGS. 5*a* through 5*d* illustrate several embodiments of shapes of cable 30 that may be used with the present invention.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. A portable minature container assembly adapted for releasable attachment to a closed band member, which assembly may be selectively opened for providing easy access to its contents, and which may be attached and released from the closed band member without having to open the band member, the assembly comprising:

a plastic container having at least two opposite side walls, a bottom wall, and a water-tight, integrally formed, hinged lid that, in its open position, permits access to the interior of said container;

at least one pair of separate finger members, each finger member of said pair being integrally formed on an opposite side wall of said container adjacent said bottom wall and protruding outward therefrom, each of said finger members being aligned with one another; and said finger members having extending hooked portions, free ends of the hooked portions receive and releasably retain an elongated flexible member between said finger members and said side wall of said container, said elongated flexible member encircling a portion of the band member and releasably engaging said pair of finger members to retain said bottom wall of said container against said closed band member.

2. The container assembly of claim 1 wherein said elongated flexible member is made of elastomeric material.

3. A portable minature container assembly adapted for releasable attachment to a closed band member, which assembly may be selectively opened for providing easy access to its contents, and which may be attached and released from the closed band member without having to open the band member, the assembly comprising:

a plastic container having a contiguous, volume containing side wall, a bottom wall, and a water-tight, integrally formed, hinged lid that, in its open position, permits access to the interior of said container;

at least one pair of separate finger members, each finger member of said pair being formed adjacent a side wall of said container on opposite sides of said bottom wall and protruding outward therefrom, each of said finger members being aligned with one another; and said finger members having extending hooked portions, free ends of the hooked portions receive and releasably retain an elongated flexible member between said finger members and said side wall of said container, said elongated flexible member encircling a portion of the band member and releasably engaging said pair of finger members to retain said bottom wall of said container against said closed band member.

4. The container assembly of claim 3 wherein said elongated flexible member is made of elastomeric material.

* * * * *